United States Patent [19]

Phalon

[11] 4,079,740

[45] Mar. 21, 1978

[54] EAR LOBE PIERCING SYSTEM

[76] Inventor: Joseph E. Phalon, 274 Jackson St., Warrenton, Va. 22186

[21] Appl. No.: 617,830

[22] Filed: Sep. 29, 1975

[51] Int. Cl.[2] ..... A61B 17/00

[52] U.S. Cl. ..... 128/330

[58] Field of Search ..... 128/330

[56] References Cited

U.S. PATENT DOCUMENTS

| | | | |
|---|---|---|---|
| 2,570,048 | 10/1951 | Cooke et al. | 128/330 X |
| 3,187,751 | 6/1965 | Coren et al. | 128/330 |
| 3,941,134 | 3/1976 | McDonald | 128/330 |
| 3,943,935 | 3/1976 | Cameron | 128/330 |
| 4,009,718 | 3/1977 | Hastings | 128/330 |

FOREIGN PATENT DOCUMENTS

| | | | |
|---|---|---|---|
| 697,196 | 11/1964 | Canada | 128/330 |
| 1,309,709 | 3/1973 | United Kingdom | 128/330 |

*Primary Examiner*—Robert W. Michell
*Assistant Examiner*—Michael H. Thaler
*Attorney, Agent, or Firm*—Edmond T. Patnaude

[57] ABSTRACT

A piercing system employs a gun-like instrument in conjunction with encapsulated ball type piercers for sterile piercing of ear lobes.

3 Claims, 5 Drawing Figures

EAR LOBE PIERCING SYSTEM

The present invention relates in general to the art of piercing human ear lobes, and it relates in particular to a new and improved ear piercing system wherein a piercing stud is retained in a package until opened and in a aseptic state until it penetrates the ear lobe being pierced.

BACKGROUND OF THE INVENTION

The piercing of ear lobes to facilitate the attachment of ornamentation thereto is a social custom dating back at least to the pyramids of Egypt. Today the usual procedure for professionally piercing an ear lobe is to wash, rinse and cleanse the ear lobe and then to pierce the lobe with a metal, often gold or gold plated, pierce mounted on a syringe-like device. The syringe device is presumably disinfected between uses, but the patient has no assurance that such is the case nor does practical experience justify such a presumption. When the piercing is done on a nonprofessional basis invection is an ever present hazard.

SUMMARY OF THE INVENTION

Briefly, the present invention provides a new and improved system which includes an instrument for receiving cartridges in which the piercing studs and clutches are sterilly packaged. The instrument is positioned with the stud and clutch cartridges firmly pressed against opposite sides of the lobe to be pierced, and a trigger is actuated to press the stud out of the cartridge, through the lobe and into the clutch.

In order to permit the use of the type of stud having a ball at the end, the stud cartridge has a cylindrical bore slidably receiving the ball, and a thin, fragmentable disc is provided at one end of the bore. The pointed end of the stud is positioned in a central recess in the disc so that when the instrument is triggered the stud passes through the center of the disc before penetrating the ear lobe. The disc thus functions as a guide bushing to assure that the shank of the stud moves in an axial direction through the cartridge and into the ear lobe. After the stud is in place in the ear lobe the disc breaks into pieces which separates from the pierce while the stud remains in the ear lobe.

BRIEF DESCRIPTION OF THE DRAWINGS

Further objects and advantages and a better understanding of the present invention can be had by reference to the following detailed description, wherein.

DETAILED DESCRIPTION OF THE INVENTION

Figure 1:
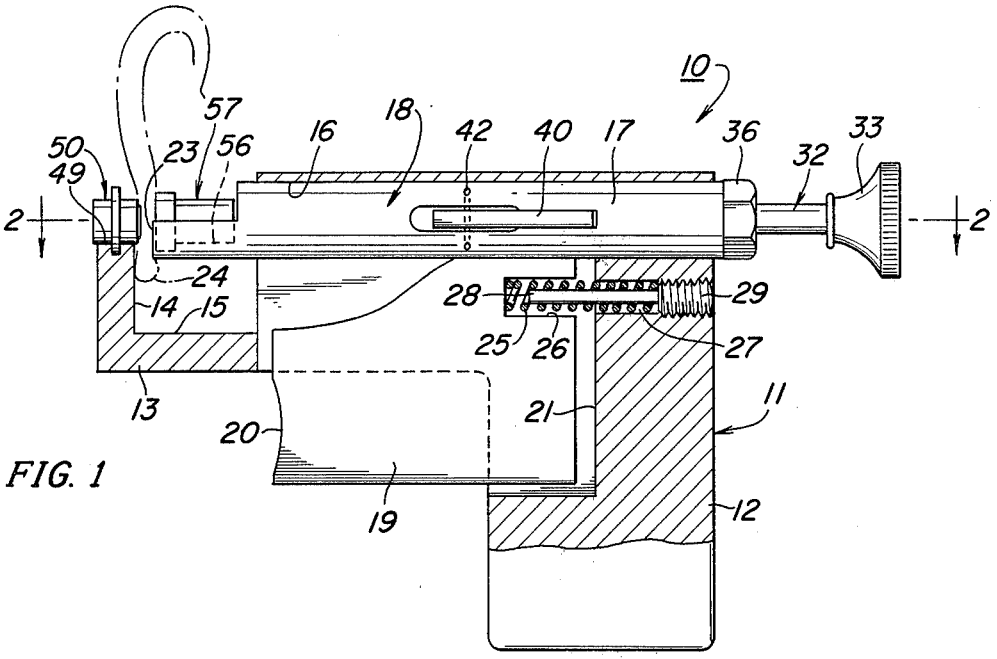
FIG. 1, is an elevational view, partly in section of an ear lobe piercing system.
Figure 2:
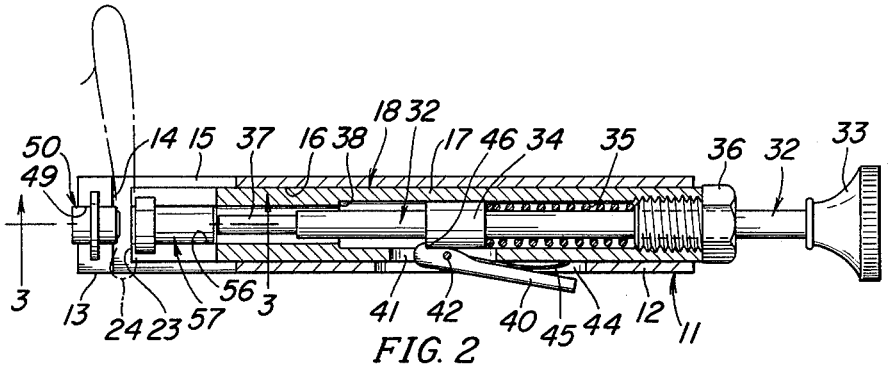
FIG. 2 is a sectional view taken along the line 2—2 of FIG. 1.

Referring particularly to FIGS. 1 and 2, a gun-like instrument 10 comprises a main housing 11 having a rearwardly disposed handle portion 12 and a forwardly extending portion 13 providing a fixed, rearwardly facing jaw 14. The housing 11 further includes a cylindrical bore 16 which slidably receives an upper tubular section 17 of a finger operated reciprocable firing assembly 18. Integral with the tubular section 17 is a depending plate 19 having a finger receiving recess 20 at the front. As shown in FIG. 1, the housing 11 is notched out to provide a slot 21 in which the plate 19 slides. The width of the slot 21 is slightly greater than the thickness of the plate 19 and the sides of the slot prevent rotational movement of the section 17 in the bore 16.

The forward section 13 of the housing has an upwardly opening recess 15 into which the forward end of the tubular section 17 extends. The forward end of the section 17 is identified at 23 and provides a second jaw which is movable toward and away from the fixed jaw 14 to grip an ear lobe 24 between the jaws 14 and 23. A light coil spring 25 is mounted in a pair of aligned openings 26 and 27 respectively provided in the rear of the plate 19 and the housing 11 to urge the firing assembly 18 and thus the movable jaw 23 in a forward direction. A guide rod 28 extends through the spring 25 which is held in place by a socket head machine screw 29 threadedly received in the rear end of the opening 27.

Slidably mounted in the bore through the tubular section 17 is a drive rod 32 having a knob 33 secured to the rear end thereof. The rod 32 has an enlargement 34 near the center and a coil spring 35 is compressed between the rear end of the enlargement 34 and a cap nut 36 received in a threaded counter bore at the rear of the tubular section 17. The nut 36 has an axial bore which slidably receives the drive rod 32 to provide a rear bushing therefor. The forward end portion of the drive rod 32 is identified by the number 37 and a rearwardly facing annular shoulder 38 in the bore of the section 17 provides a stop surface which is engaged by the forward end of the enlargement 34 to limit the forward movement of the drive rod.

In order to releasably lock the drive rod in a retracted position, a trigger member 40 extends through a slot 41 in the side of the tubular section 17 and is pivotally mounted thereto by means of a pivot pin 42. The housing 11 is provided with a slot 44 through which the rear portion of the trigger extends and a leaf spring 45 carried by the trigger presses against the side of the section 17 to bias the forward end of the trigger into the bore. The forward end portion of the trigger is notched to provide a rearwardly facing shoulder 46 which engages the forward end of the enlargement 34 to hold the drive rod 32 in the retracted, cocked position as best shown in FIG. 2. When the rear end portion of the trigger 40 is pressed in, the shoulder 46 moves out of engagement with the forward end of the enlargement 34 whereupon the spring 35 drives the drive rod 32 to its forwardmost position. The rod 32 is cocked simply by pulling back on the knob until the trigger 40 snaps into the locking position and then releasing the knob. Since the spring 35 preferably has a substantially higher spring constant than the spring 25, the knob 33 may, if desired, be used instead of the plate 19 to open the ear lobe engaging jaws 14 and 23. I have found, however, that it is much easier to accurately position the jaws on the ear lobe using one hand to both hold the instrument 10 and to actuate the movable jaw 23.

The top of the fixed jaw 14 is provided with a semicylindrical recess 49 adapted to receive a generally cylindrical cartridge 50 carrying a clutch 51 of conventional construction. The cartridge 50 has an external annular flange 52 intermediate the ends thereof for receipt in a complimentary slot 53 in the jaw 14 to prevent axial movement of the cartridge 50. The spring loops of the clutch 51 are press fitted into rectangular slots 54 in the end of the cartridge 50 adjacent the ear lobe 24.

Figure 3:
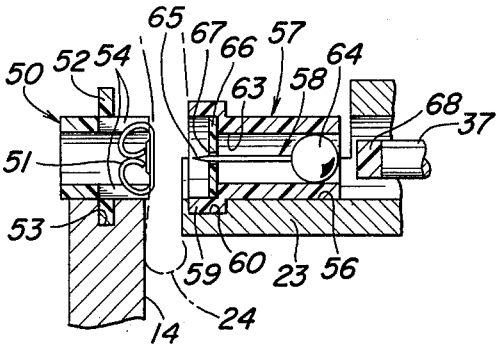
FIG. 3 is a sectional view taken along the line 3—3 of FIG. 2.

The top of the movable jaw 23 is also provided with a semicylindrical recess 56 adapted to receive a generally cylindrical cartridge 57 carrying a piercing stud 58 as best shown in FIG. 3. When in place on the jaws, the cartridges 50 and 57 are coaxial with the drive rod 32. The cartridge 57 has an external annular flange 59 at the forward end for receipt in a complimentary groove 60 in the jaw 23. The cartridge 57 has a cylindrical bore 63 into which the ball portion 64 of the stud 58 is press fitted. The pointed end 65 of the stud shank is positioned in a central hole 67 in a fragmentable disc 66 press fitted in an annular recess or rabbit at the front end of the cartridge 57. The forward portion 37 of the drive rod 32 has a smaller diameter than does the bore 63, and being aligned therewith, pushes the stud 58 through the disc 66 and the ear lobe 24 into the central aperture in the clutch 51. As best shown in FIG. 3, the rod section 37 has an elastomeric end portion 68 suitably formed of soft rubber and having a concave end conforming to the shape of the ball to prevent damage to the ball 64 which may be relatively soft as, for example, where it is a solid gold piece.

Figure 4:
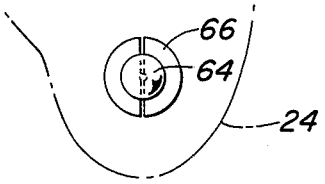
FIG. 4, is a view of an ear lobe just after piercing before removal of the guide disc.

The disc 66 is a thin plastic part having a diametric line of weakness molded or scored therein. The disc 66 may also be two separate semicircular pieces held together in the cartridge. As the post of the stud passes through the central hole in the disc 66 it exerts an expansive force on the disc so that when the disc is pushed out of the cartridge near the end of the piercing operation it causes the disc to separate along its diameter to the condition shown in FIG. 4. After the instrument is moved away from the ear lobe the separated parts of the disc 66 generally fall off or, if necessary, can be easily removed by the person doing the piercing.

Preferably the cartridges 50 and 57 are completely packaged and then sterilized. In addition to providing the closure for the cartridge 57, the disc 66 provides a forward guide bushing which holds the post of the stud in an axial position as it penetrates the ear lobe. The use of ball type studs is thus made possible.

The provision of the spring loaded drive rod and trigger release assures that the stud will be abruptly driven through the ear lobe, and the internal stop shoulder 38 prevents the ball 64 from being driven against the ear lobe while avoiding the possibility of the sharp end of the stud penetrating the head of the patient.

In use two pairs of cartridge sets 50 and 57 are packaged together with suitable instructions and a towelette for topical disinfection of the ear lobe prior to piercing. Each lobe to be pierced may be marked at the desired location of the pierce and the jaws 14 and 23 placed on the lobe in alignment with the mark. Using the thumb of the hand holding the instrument 10, the trigger is then released causing the stud to pierce the ear. Since only one hand is required to position the jaws and actuate the trigger, the other hand can be used to hold the ear lobe.

Figure 5:
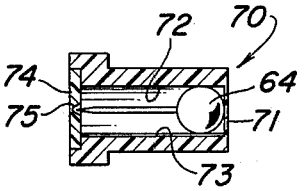
FIG. 5 is a sectional view of an alternative cartridge construction.

Referring to FIG. 5, there is shown an alternative cartridge 70 which may be used with the instrument 10 and which maintains the stud in a completely sterile condition until it exits the cartridge during the piercing operation. As shown, the cartridge 70 has a thin wall at the rear of the cylindrical bore 72 in which the ball 64 is fitted. A narrow longitudinal groove 73 is provided in the wall of the bore 72 to vent air from the rear of the bore as the stud is pressed therein. A fragmentable disc 74 scored along a diameter thereof is press fitted into a counterbore at the forward end of the cartridge and has a central depression 75 on the inner side to receive the point of the stud. The point of the stud does not actually penetrate the disc 74 until after the trigger 40 is actuated and the ear lobe piercing operation is initiated. The depression 75 assures that the stud initially penetrates the center of the disc 74 which then provides a guide bushing as the post of the stud passes therethrough.

The cartridges 50 and 57 may be injection molded of a suitable plastic such, for example, as polystyrene, and the wall 71 in the embodiment of FIG. 5 may be a very thin flashing of a few thousandths of an inch.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A system for piercing studs through ear lobes,
comprising an instrument having first and second jaws, means mounting said jaws in mutually aligned relationship
for movement toward and away from one another, a piercing stud having a shank pointed at one end and a
ball at the other end, a first cartridge having a cylindrical bore, said stud being located in said cartridge with said ball
slidably disposed in said bore, a thin disc mounted in said bore near one end thereof, said shank extending into the center of said disc, means for removably mounting said first cartridge in one
of said jaws with said pointed end of said stud
directed toward said second jaw, a second cartridge having a clutch located therein, means removably mounting said second cartridge in said
second jaw in axial alignment with the shank
of said stud, and means carried by said instrument for exerting an axial
force on said ball to push said ball through said
bore and to push said pointed end of said shank
into said clutch.

2. A system according to claim 1 wherein said disc comprises
two semi-circular members,
said stud being disposed between said semi-circular members.

3. A system according to claim 1 wherein
said first cartridge has a counterbore at the end thereof facing said second cartridge, and
said disc is slidably disposed in said counterbore.

* * * * *

UNITED STATES PATENT AND TRADEMARK OFFICE

CERTIFICATE OF CORRECTION

PATENT NO. : 4,079,740

DATED : March 21, 1978

INVENTOR(S) : Joseph E. Phalon

It is certified that error appears in the above-identified patent and that said Letters Patent are hereby corrected as shown below:

Claim 1. A system for piercing studs through ear lobes, comprising an instrument having first and second jaws, means mounting said jaws in mutually aligned relationship for movement toward and away from one another, a piercing stud having a shank pointed at one end and a ball at the other end, a first cartridge having a cylindrical bore, said stud being located in said cartridge with said ball slidably disposed in said bore, a thin disc mounted in said bore near one end thereof, said shank extending into the center of said disc, means for removably mounting said first cartridge in one of said jaws with said pointed end of said stud directed toward said second jaw, a second cartridge having a clutch located therein, means removably mounting said second cartridge in said second jaw in axial alignment with the shank of said stud, and

UNITED STATES PATENT AND TRADEMARK OFFICE

CERTIFICATE OF CORRECTION

PATENT NO. : 4,079,740 Page 2 of 2

DATED : March 21, 1978

INVENTOR(S) : Joseph E. Phalon

It is certified that error appears in the above-identified patent and that said Letters Patent are hereby corrected as shown below:

Claim 1 continued means carried by said instrument for exerting an axial force on said ball to push said ball through said bore and to push said pointed end of said shank into said clutch.

Signed and Sealed this

*Thirteenth* Day of *January 1981*

[SEAL]

*Attest:*

SIDNEY A. DIAMOND

*Attesting Officer* *Commissioner of Patents and Trademarks*